United States Patent [19]

Hutchins

[11] 4,228,620

[45] Oct. 21, 1980

[54] ABRADING TOOL WITH WEAR PLATE

[75] Inventor: Donald H. Hutchins, Sierra Madre, Calif.

[73] Assignee: Hutchins Manufacturing Company, Pasadena, Calif.

[21] Appl. No.: 12,157

[22] Filed: Feb. 14, 1979

[51] Int. Cl.[3] ..... B24B 23/00

[52] U.S. Cl. ..... 51/170 TL; 308/3 A; 308/3 C

[58] Field of Search ..... 51/170 TL, 170 R, 170 MT, 51/175; 308/3 A, 3 C, 3 R

[56] References Cited

U.S. PATENT DOCUMENTS

| | | | |
|---|---|---|---|
| 955,896 | 4/1910 | Morrison | 91/179 |
| 987,940 | 3/1911 | Anderson | 51/170 TL |
| 1,493,650 | 5/1924 | Sundstrand | 91/185 |
| 2,282,648 | 5/1942 | Drefahl | 51/170 TL |
| 3,108,409 | 10/1963 | Hendrickson | 51/170 TL |
| 3,214,823 | 11/1965 | Hendrickson | 51/170 TL |
| 3,399,494 | 9/1968 | Hendrickson | 51/170 TL |
| 3,724,895 | 9/1966 | Hendrickson | 51/170 R |
| 3,803,773 | 4/1974 | Odawara | 51/170 TL |
| 3,932,963 | 1/1976 | Hutchins | 51/170 TL |
| 4,052,824 | 10/1977 | Hutchins | 51/170 MT |
| 4,145,847 | 3/1979 | Hutchins | 51/170 TL |

*Primary Examiner*—Othell M. Simpson
*Assistant Examiner*—Roscoe V. Parker
*Attorney, Agent, or Firm*—William P. Green

[57] ABSTRACT

A portable abrading tool having a shoe plate mounted to the underside of a portable body for powered reciprocation, and retained by tracks projecting downwardly from the body and extending inwardly beneath the shoe, with a wear plate being carried above the shoe for engagement with downwardly facing bearing means at the underside of the body. The wear plate desirably has relatively wide end portions engageable with front and rear pairs of bearings, and a reduced width intermediate portion received between toothed racks on the shoe.

9 Claims, 7 Drawing Figures

FIG. 1
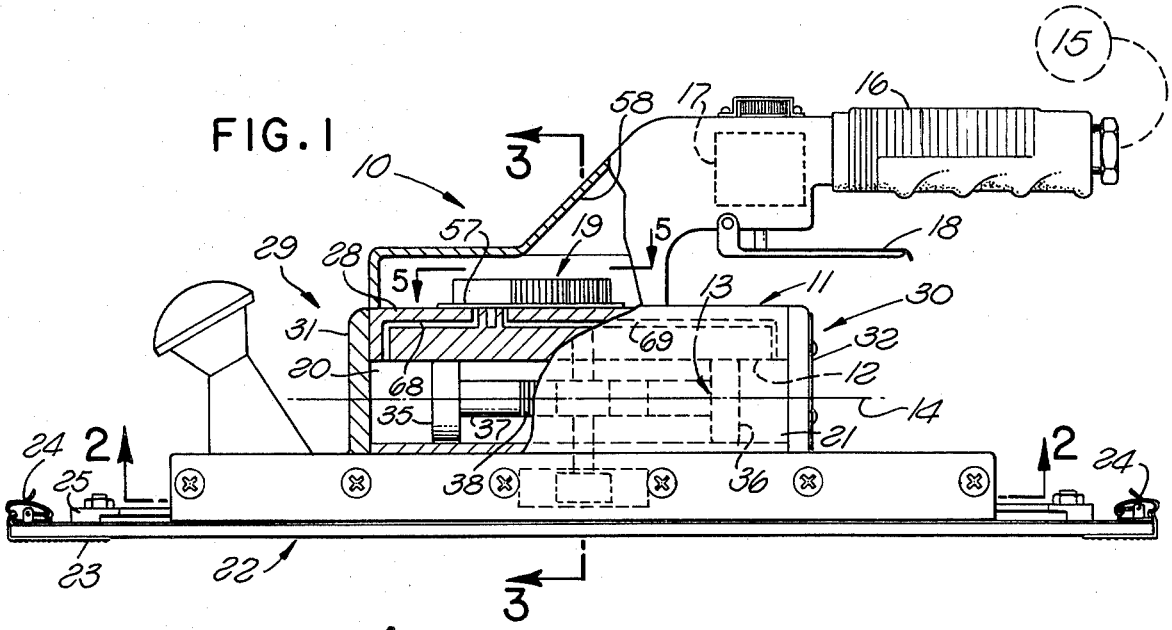
FIG. 2
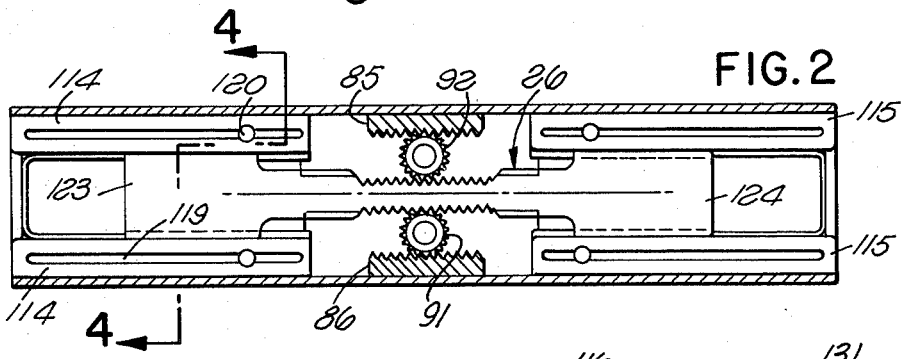
FIG. 3
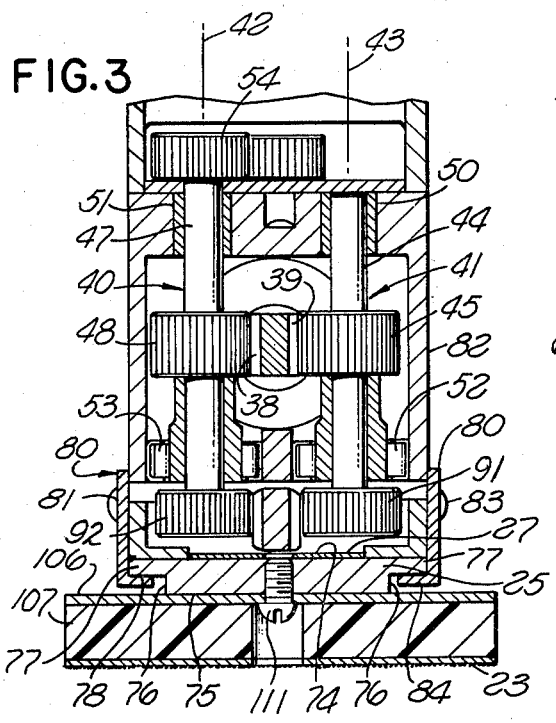
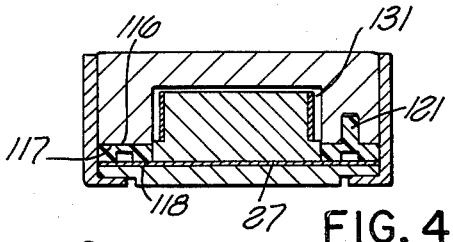
FIG. 4
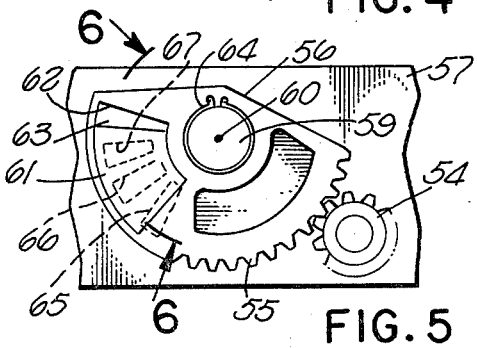
FIG. 5
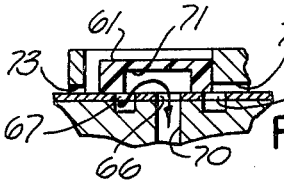
FIG. 6

ABRADING TOOL WITH WEAR PLATE

BACKGROUND OF THE INVENTION

This invention relates to portable powered abrading tools, such as power sanders, of a type having an abrading shoe mounted for straight line reciprocating movement relative to a carrying body.

U.S. Pat. Nos. 3,932,963 and 4,052,824, and pending U.S. patent application Ser. No. 869,373 filed Jan. 13, 1978 by Mr. Alma A. Hutchins on "Straight Line Abrading Tool With Balancing Counterweight", are directed to a type of straight line reciprocating abrading tool in which a handle body containing a motor carries at its underside a shoe plate which is guided for reciprocating movement relative to the body and is driven for such movement by the motor. A sanding pad or other abrading unit can be secured to the reciprocating shoe for movement therewith. The motor is desirably a piston and cylinder mechanism acting to rotatably oscillate spaced gears carried at the underside of the handle body, with the gears engaging racks projecting upwardly from the shoe plate to reciprocate the shoe in response to rotary oscillation of the gears. Application Ser. No. 869,373 shows a counterweight unit in such an arrangement, located between the underside of the handle body and the upper surface of the reciprocating shoe. The shoe is retained and guided by tracks or other guide means projecting downwardly from the body and engaging the underside of the shoe plate to retain it against downward movement away from the body. The shoe plate is retained at its upper side by engagement with bearing elements carried at the bottom of the handle body.

SUMMARY OF THE INVENTION

The present invention is directed to improvements in a power operated abrading tool of the above discussed general type, and in particular relates to incorporation in such a tool of a wear plate at a particular location and in a particular relationship to certain of the parts of the device to prevent wear on those parts and enable restoration of the tool after a long period of use to substantially its original condition by replacement of the wear plate. More particularly, the wear plate protects the upper surface of the shoe against wear in use as a result of its contact with the bearing elements at the underside of the tool body.

The wear plate is mounted to the upper side of the shoe and preferably retained in fixed position relative thereto by fasteners extending upwardly through the shoe and wear plate. These same fasteners may also serve as the retaining elements for securing the sandpaper carrying pad or other abrading unit to the underside of the shoe itself The wear plate may be a thin sheet of spring steel, or other appropriate highly wear resistant material, and may extend across essentially the entire width of the upper surface of the shoe so that a single one piece wear plate may have opposite side edges engageable with two spaced bearing elements carried by the body near opposite sides thereof.

The shoe desirably has at least one and preferably two racks projecting upwardly for engagement with a drive gear or gears. The wear plate preferably has a reduced width portion at the location of the rack or racks, to pass the racks upwardly for engagement with the drive gear or gears, and has portions of greater width in front of and behind the rack location each engageable with a pair of bearing elements carried by the body of the tool. The wear plate, in addition to serving the discussed purpose of taking downward forces exerted by the handle body, may also function to slidably support a counterweight located vertically between the body and the shoe.

BRIEF DESCRIPTION OF THE DRAWINGS

The above and other features and objects of the invention will be better understood from the following detailed description of the typical embodiment illustrated in the accompanying drawings, in which:

FIG. 1 is a side elevational view, partially broken away, of a power sander constructed in accordance with the invention;

FIG. 2 is a bottom view of the tool body, taken on line 2—2 of FIG. 1;

FIG. 3 is an enlarged vertical section taken on line 3—3 of FIG. 1;

FIG. 4 is a vertical section taken on line 4—4 of FIG. 2;

FIG. 5 is an enlarged detail representation of the automatic valving mechanism, taken on line 5—5 of FIG. 1;

FIG. 6 is a fragmentary vertical section taken on line 6—6 of FIG. 5.

DETAILED DESCRIPTION OF THE PREFERRED EMBODIMENT

Figure 7:
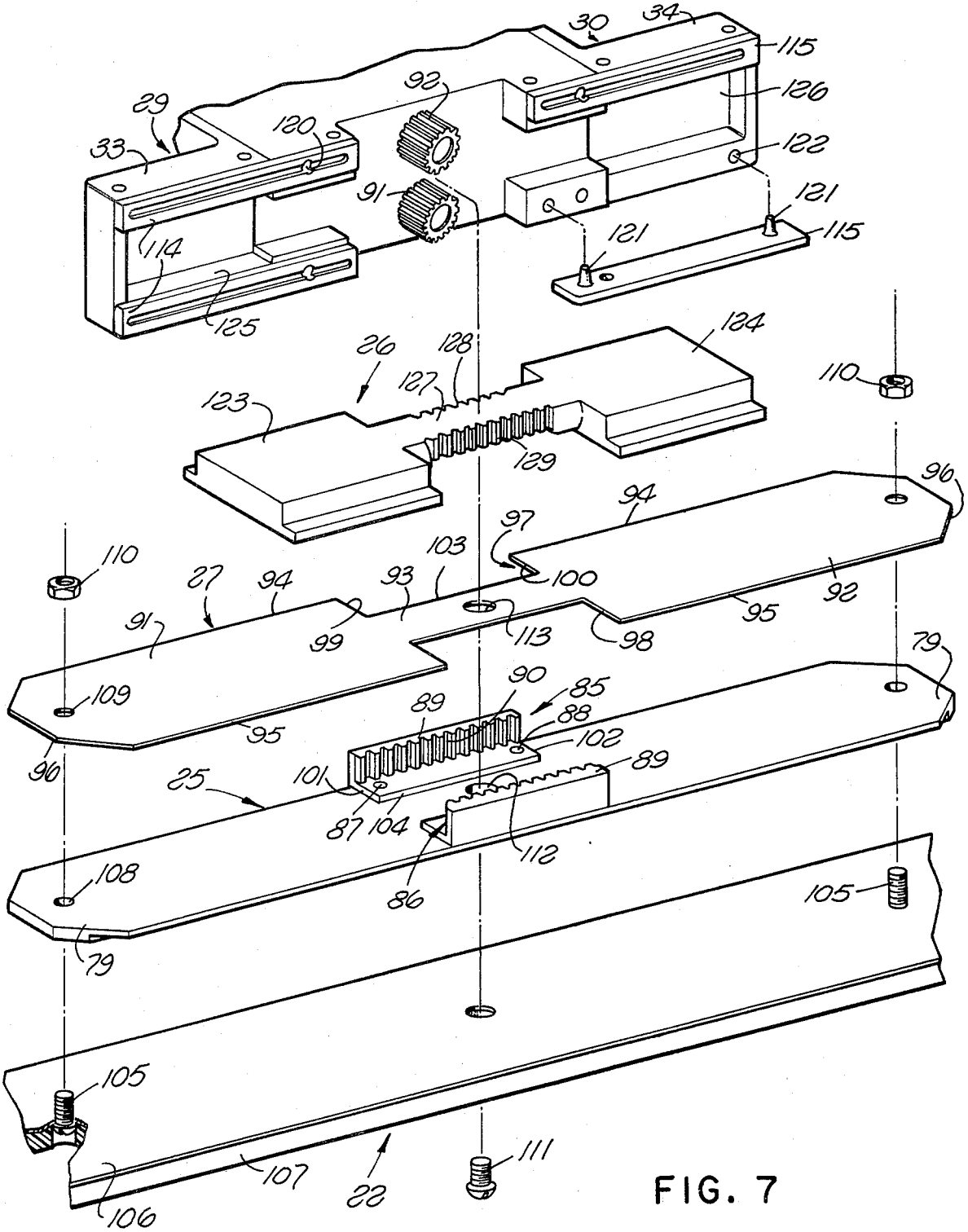
FIG. 7 is an exploded perspective view of the underside of the tool body and the parts carried beneath the tool body.

The sander 10 of FIG. 1 includes a main body 11 containing a cylindrical bore 12 within which a piston 13 is reciprocated along an axis 14. A source 15 of compressed air or other pressure fluid delivers such fluid to the opposite ends of cylinder bore 12 through a tubular handle 16 which is rigidly secured to or forms a portion of body 11. The delivery of compressed air to the reciprocating piston is controlled by a valve 17 manually actuated by a trigger element 18, and additionally is controlled by an automatic valve assembly 19 which alternately admits the compressed air to cylinder chambers 20 and 21 at opposite ends of the piston at times to cause powered reciprocation of the piston. A pad or cushion assembly 22 extending along the underside of body 11 is reciprocated in a straight line motion parallel to axis 14, and carries a sheet of sandpaper 23 at its underside for abrading a work surface upon such reciprocating movement. The sandpaper sheet is secured detachably to pad 22, as by spring clips 24 or by an appropriate adhesive securing the sandpaper to the underside of the pad.

Pad 22 is carried by a shoe plate 25, mounted slidably to body 11. A counterweight 26 is received vertically between shoe plate 25 and body 11 and is reciprocated with piston 13 and oppositely from the shoe plate and pad 22 to attain an overall balance preventing or minimizing vibration of the body itself. The wear plate with which the present invention is particularly concerned is shown at 27 in the drawings, and is carried at the upper side of shoe plate 25 for movement therewith.

Body 11 may be formed of a number of parts, including a main central section 28 and two opposite end members 29 and 30 having vertical portions 31 and 32 secured to the opposite ends of section 28 to close bore 12. The lower portions of end members 29 and 30 project horizontally in opposite directions at 33 and 34 (see FIG. 7) at the upper side of shoe plate 25.

Piston 13 is preferably of a double-ended type, having enlarged piston heads 35 and 36 at its opposite ends connected together by a reduced diameter portion 37 having two sets of rack teeth 38 and 39 extending along its opposite sides and facing in opposite horizontal directions transversely of the axis 14 of piston reciprocation. Engaged with these rack teeth 38 and 39 on the piston structure are two gear units 40 and 41 mounted to turn about two parallel vertical axes 42 and 43 (FIG. 3) lying in a common vertical plane disposed transversely of axis 14. One of these gear units 41 includes a vertical shaft 44 rigidly carrying two vertically spaced gears 45 and 91, the first of which meshes with and is oscillated rotatively by the rack teeth 39 on piston 13. The other gear unit 40 has a similar vertical shaft 47 rigidly carrying two vertically spaced gears 49 and 92, the first of which engages the second set of rack teeth 38 on piston 13. In order to mount the shafts 44 and 47 for rotation relative to body 11, upper portions of these shafts may be journaled within a pair of sleeve bushings 50 and 51, and lower portions of the shafts may be journaled within roller bearings or other suitable bearing assemblies 52 and 53, desirably constructed to function as thrust type bearings to support shaft 44 and 47 in the FIG. 3 positions.

The valve mechanism 19 may be any appropriate valving unit capable of admitting compressed air alternately to the two cylinder chambers 20 and 21 at opposite ends of the piston, in order to reciprocate the piston. The preferred type of valving mechanism illustrated in FIGS. 5 and 6 corresponds to that shown in the above discussed prior patents and application, and is driven by one of the two previously mentioned shafts 44 and 47, typically the latter as seen in FIG. 3. More specifically, shaft 47 may rigidly carry at its upper end another gear 54, meshing with an arcuate series of teeth 55 on a sector element 56 (FIG. 5) received adjacent on upper horizontal plate 57 secured to the top surface of main body section 28. Referring to FIG. 1, the air from source 15 flows past manually actuated valve 17 into an inlet chamber 58 formed at the top of body part 28 and between that part and the hollow handle member 16. The valve mechanism has been discussed in detail in prior U.S. Pat. No. 3,932,963, and will not be described as specifically in the present application. Sector part 56 of this valve mechanism is mounted by a post 59 projecting upwardly from plate 57 for rotary oscillating movement about a vertical axis 60, to actuate a valve element 61 which is shaped essentially as a sector of a circle and is received within a similarly shaped recess 62 formed in sector 56. The sector-shaped recess 62 has somewhat greater arcuate extent than does sector-shaped valve element 61, to allow a gap 63 between part 61 and the side or sides of the recess or opening 62, so that there is some lost motion between the oscillation of part 56 and part 61. The vertical post 59 is rigidly secured to plate 57, and may carry a snap ring 64 retaining part 55 on the post and against the upper surface of plate 57. Plate 57 contains three radially elongated sector-shaped apertures 65, 66 and 67 (FIGS. 5 and 6). Of these, the two end apertures 65 and 67 communicate with two passages 69 and 68 respectively in body part 28 leading to chambers 21 and 20 at opposite ends of the piston. The middle aperture 66 communicates with an exhaust passage 70 through which air may be discharged from the valve assembly to atmosphere. As seen in FIG. 6, the valving element 61 contains a sector shaped recess 71 at its underside of a width to place exhaust passage 70 alternately in communication with the two passages 65 and 67 respectively. In the particular position illustrated in FIG. 6, the passage 67 is exhausting to atmosphere, while the passage 65 is receiving inlet air from chamber 58 through a gap or passage 72 provided at the underside of the sector element 55. When the sector element 56 oscillates in a counterclockwise direction from the position of FIG. 5, element 61 is shifted a short distance after a period of lost motion whose extent is determined by the width of gap 63, with element 61 ultimately moving to a position in which passages 65 and 70 are placed in communication with one another through chamber 71 at the underside of element 61, and with passage 67 then being in communication with the inlet air chamber 58 through a gap 73 formed at the underside of sector part 55. As will be apparent without further discussion, the oscillating valve element 61 thus first admits air to chamber 20 at the left side of piston 13 in FIG. 1 while exhausting air from chamber 21 at the right end of the piston, and then at the end of a rightward stroke of the piston reverses the connections to admit air to chamber 21 and exhaust it from chamber 20 and cause leftward movement of the piston, thus resulting in automatic reciprocation of the piston and corresponding rotary oscillation of the gear units 40 and 41.

The shoe plate 25 is a rigid preferably metal part having the cross-section illustrated in FIG. 3, to form an upper horizontal planar surface 74 and a parallel planar horizontal undersurface 75. Along its opposite sides, the shoe contains two recesses 76 at its underside forming a pair of laterally projecting reduced thickness flanges 77 extending parallel to axis 14. The undersurfaces 78 of these flanges are horizontal and coplanar. This discussed cross-section of shoe 25 as shown in FIG. 3 is uniform along the entire length of the shoe plate, except at its opposite ends which may be tapered to reduced widths as represented at 79 in FIG. 7.

The shoe plate 25 is slidably guided and retained against downward movement relative to body 11 by a pair of track or rail members 80, having vertical portions 81 received against the vertical side surfaces 82 of the various body sections 28, 29 and 30, and secured thereto by screws 83. At their lower edges, the two track elements 80 have horizontally inturned flanges 84, whose coplanar upper horizontal surfaces slidably engage the undersurfaces 78 of flanges 77 of the shoe plate, to guide it for straight line reciprocating movement parallel to axis 14. As will be apparent from FIG. 3, the opposite edges of flanges 77 engage and are slidably retained by the vertical portions 81 of guide tracks 80 to retain shoe plate 25 against lateral movement. The cross-sections of tracks 80 as seen in FIG. 3 are uniform along the entire front to rear extent of the body.

At its upper side, shoe plate 25 has two rack members 85 and 86, having horizontal mounting portions 87 secured by rivets or screws 88, or otherwise, to shoe 25. Racks 85 and 86 have upwardly projecting portions 89 with horizontally inwardly facing rack teeth 90 engageable with a pair of gears 91 and 92 rigidly carried and rotatably driven by the lower ends of shafts 44 and 47, to reciprocate shoe 25 in a front to rear direction in response to rotary oscillation of shafts 44 and 47 by piston 13.

The wear plate 27 with which the present invention is particularly concerned is preferably formed of a thin single piece of sheet material, desirably spring steel, which is planar and horizontal and rests on the upper surface 74 of shoe 25. As seen in FIG. 7, wear plate 27 has front and rear relatively wide portions 91 and 92, received in front of and behind the location of racks 85 and 86, and an intermediate narrower portion 93 received between the two racks. The wider portions 91 and 92 are of a transverse width corresponding to the width of shoe plate 25, and are defined by parallel opposite side edges 94 and 95 extending in a front to rear direction and located directly above the opposite edges of shoe 25. The ends of wear plate 27 may have tapered end portions 96 corresponding to and overlying the tapered end portions 79 of shoe 25. The narrower portion 93 of wear plate 27 is formed by providing two rectangular recesses or cutaway regions 97 and 98 dimensioned to exactly receive the horizontal mounting flanges or portions 87 of the two racks 85 and 86. More particularly, each of the recesses 97 and 98 may be defined by two transverse parallel edges 99 and 100 received adjacent corresponding transverse parallel edges 101 and 102 of the corresponding rack, and a longitudinally extending edge 103 received adjacent longitudinally extending edge 104 of the corresponding rack.

The wear plate 27 is secured to the upper surface of shoe 25 by a pair of screws 105, which also serve to retain pad 22 to the shoe. As seen in FIG. 3, pad 22 includes an upper essentially stiff preferably metal horizontal plate 106, carrying at its underside a pad 107 formed of rubber or other elastomeric material and suitably adhered to plate 106. Screws 105 extend upwardly through openings in cushion 107, and have enlarged heads engageable upwardly against plate 106, with the shanks of screws 105 extending upwardly through registering openings 207, 108 and 109 in plate 106, shoe plate 25 and wear plate 27, and being connected to nuts 110 to tightly clamp the three elements 22, 25 and 27 together. As seen in FIG. 3, a similar but shorter screw 111 secures pad 22 to shoe plate 25 at a longitudinally central location, having its head abutting upwardly against plate 106 and its reduced shank engaging threads formed in an aperture 112 in plate 25. This central screw does not project upwardly beyond wear plate 27. A central aperture 113 of the wear plate above opening 112 permits the shank of screw 11 to extend very slightly beyond plate 25 without interfering with counterweight 26.

For slidably engaging the upper surface of wear plate 91, the three sections 28, 29 and 30 of tool body 11 carry a forward pair of bearing elements 114, and a rear pair of similar bearing elements 115, all formed as thin strips of an appropriate low friction, low wear resinous plastic material. Each of these bearing elements 114 and 115 is elongated in a front to rear direction, and may have the cross section illustrated in FIG. 4, to present an upper horizontal surface 116 engaged against a downwardly facing horizontal surface 117 on the sectionally formed body structure, and having an essentially horizontal undersurface 118 slidably engaging the upper surface of wear plate 27. The undersurface 118 of each of the bearing elements 114 and 115 may contain a groove 119 elongated in a front to rear direction and into which a lubricant may be fed through an opening 120 communicating with a supply passage in the body. The two forward bearing elements 114 are received adjacent the opposite sides respectively of the body structure, to slidably engage opposite edge portions of plate 27, at a location forwardly of gears 91 and 92, while the two rear bearing elements 115 are similarly located adjacent opposite sides of the body but rearwardly of gears 91 and 92. Each of the bearing elements 114 and 115 may be secured in fixed position relative to the body structure 11 by extension of integral projections 121 at the upper side of the bearing element into bores 122 formed in the underside of the body. Bearing elements 114 and 115 thus act to transmit downward forces from the body to the shoe assembly, and co-act with tracks 80 is retaining the shoe assembly against movement in any direction other than its desired straight line horizontal reciprocating movement.

Counterweight 26 has front and rear relatively wide portions 123 and 124 slidably received and guided within front and rear recesses 125 and 126 formed in body 11 laterally between the locations of tracks 114 and 115. An intermediate reduced width portion 127 of the counterweight is received between the two gears 91 and 92, and has two sets of rack teeth 128 and 129 at its opposite sides meshing with the teeth on gears 91 and 92 to cause straight line front to rear reciprocation of the counterweight corresponding to and in the same direction as the reciprocation of piston 13. The cross-section of each of the wider portions 123 and 124 of the counterweight may be as shown in FIG. 4, defining two narrow flanges 130 slidably engaging and laterally retained and guided by vertical side surfaces of the adjacent tracks 114 or 115. The upper slightly reduced width part of the counterweight as seen in FIG. 4 may be laterally retained by a U-shaped spring 131 having portions engaging opposite sides of and assisting in locating the counterweight. The counterweight is supported on and slidably engages the upper surface of wear plate 27, and is confined against upward movement relative to the body by shaping the coacting recess 125 or 126 to closely receive the counterweight and prevent movement in any direction other than the desired straight line reciprocating movement.

When the tool is in use, downward force is exerted by the body against the shoe by sliding engagement of bearing strips 114 and 115 with the upper surface of wear plate 27. Shoe 25 is thus protected against wear, and all wear takes place at the upper side of wear plate 27. The plate 25 is similarly protected against any damaging contact with the reciprocating counterweight 26, which slidably engages the wear plate 27 between bearing strips 114 and 115, and between racks 85 and 86. If at any time the wear becomes excessive, wear plate 27 can be easily removed and replaced by another wear plate, with similar replacement of bearing strips 114 and 115 if necessary, to return the sliding surfaces which take the primary forces exerted in use to their original condition.

While a certain specific embodiment of the present invention has been disclosed as typical, the invention is of course not limited to this particular form, but rather is applicable broadly to all such variations as fall within the scope of the appended claims.

I claim:

1. A portable abrading tool comprising:

a body structure;

a shoe plate carried at the underside of said body structure for reciprocation relative thereto and adapted to carry abrading means for abrading a work surface;

motor means for reciprocating said shoe plate relative to said body structure;

a pair of gears rotatively oscillated by said motor means at a location above said shoe plate;

two racks attached to said shoe plate at opposite sides thereof and projecting upwardly above the shoe plate with said gears received between the racks;

said two racks having teeth at inner sides thereof engaging said gears respectively to reciprocate the shoe plate;

guide elements extending downwardly from said body structure at opposite sides thereof and having portions received beneath the shoe plate to retain and guide it for reciprocating movement;

said body structure having a first pair of bearing structures facing downwardly toward the shoe plate near opposite edges thereof and at a location forwardly of said racks, and having a second pair of bearing structures facing downwardly toward the shoe plate near opposite edges thereof at a location rearwardly of said racks; and a wear plate removably attached to said shoe plate at the upper side thereof for reciprocating movement with the shoe plate relative to said body structure and movably engaging all four of said bearing structures in a relation retaining said shoe plate against upward movement relative to the body structure as the shoe plate reciprocates;

said wear plate having a relatively wide forward portion movably engaged near opposite edges thereof by both of said bearing structures of said first pair, and having a relatively wide rear portion movable engaged near opposite edges thereof by both of said bearing structures of said second pair, and having a longitudinally intermediate portion extending between and interconnecting said front and rear portions and narrower than said front and rear portions and received between said two racks.

2. An abrading tool as recited in claim 1, including two fasteners extending upwardly through said shoe plate and through said relatively wide forward and rear portions respectively of said wear plate and securing the wear plate to the shoe plate.

3. An abrading tool as recited in claim 1, including a pad unit carried at the underside of said shoe plate and adapted to carry at its underside a sheet of abrasive material for abrading a work surface, and two fasteners extending upwardly through registering openings in said pad unit and said shoe plate and said forward and rear relatively wide portions respectively of said wear plate and securing the pad unit and shoe plate and wear plate together.

4. An abrading tool as recited in claim 1, including a pad unit carried at the underside of said shoe plate and adapted to carry at its underside a sheet of abrasive material for abrading a work surface, and a fastener extending upwardly within registering apertures in said pad unit and said shoe plate to secure them together, said longitudinally intermediate narrower portion of said wear plate containing an opening near its center and above said fastener.

5. An abrading tool as recited in claim 1, including a pad unit carried at the underside of said shoe plate and adapted to carry at its underside a sheet of abrasive material for abrading a work surface, two screws extending upwardly through openings in said pad unit near forward and rear ends respectively thereof, and extending upwardly through registering openings in said shoe plate and in said forward and rear portions respectively of said wear plate, and having nuts above the wear plate to secure the pad unit, shoe plate and wear plate together, there being a third screw extending upwardly through said pad unit and said shoe plate at a location beneath said longitudinally intermediate narrower portion of the wear plate, said intermediate narrower portion of said wear plate containing an opening above said third screw.

6. For use with an abrading tool having a body structure, a shoe plate carried at the underside of the body structure for reciprocation relative thereto, motor means for reciprocating the shoe plate relative to the body structure, a pair of gears above the shoe plate rotatively oscillated by the motor means, two racks attached to the shoe plate at opposite sides thereof and projecting upwardly above the shoe plate with said gears received between the racks, and with the two racks having teeth at opposite sides thereof engaging the gears to reciprocate the shoe plate, guide elements extending downwardly from the body structure at opposite sides thereof and having portions received beneath the shoe plate to retain and guide it for reciprocating movement, and said body structure having a first pair of bearing structures facing downwardly toward the shoe plate near opposite edges thereof at a location forwardly of the racks, and having a second pair of bearing structures facing downwardly toward the shoe plate near opposite edges thereof at a location rearwardly of the racks:

a wear plate adapted to be removably attached to said shoe plate at the upper side thereof for reciprocating movement with the shoe plate relative to the body structure and movably engageable with all four of said bearing structures as the shoe plate reciprocates;

said wear plate having a relatively wide forward portion movably engageable near opposite edges thereof with both of said bearing structures of said first pair, and a relatively wide rear portion movably engageable near opposite edges thereof with both of said bearing structures of said second pair, and having a longitudinally intermediate portion extending between and interconnecting said front and rear portions and narrower than said front and rear portions and adapted to be received between said two racks.

7. A wear plate as recited in claim 6, in which said relatively wide forward and rear portions of said wear plate contain apertures for receiving fasteners attaching the wear plate to said shoe plate.

8. A wear plate as recited in claim 6, in which said longitudinally intermediate narrower portion of said wear plate contains an aperture.

9. A wear plate as recited in claim 6, in which said relatively wide forward and rear portions of said wear plate contain apertures for receiving fasteners attaching the wear plate to said shoe plate, said longitudinally intermediate narrower portion of said wear plate containing an opening near the center thereof.

* * * * *